US007699101B2

(12) United States Patent
Fripp et al.

(10) Patent No.: US 7,699,101 B2
(45) Date of Patent: Apr. 20, 2010

(54) WELL SYSTEM HAVING GALVANIC TIME RELEASE PLUG

(75) Inventors: Michael L. Fripp, Carrollton, TX (US); Haoyue Zhang, Dallas, TX (US); Luke W. Holderman, Dallas, TX (US); Deborah Fripp, Carrollton, TX (US); Ashok K. Santra, Duncan, OK (US); Anindya Ghosh, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 358 days.

(21) Appl. No.: 11/635,159

(22) Filed: Dec. 7, 2006

(65) Prior Publication Data

US 2008/0135249 A1 Jun. 12, 2008

(51) Int. Cl.
*E21B 43/08* (2006.01)

(52) U.S. Cl. ..... 166/229; 166/205; 166/296; 166/376

(58) Field of Classification Search ..... 166/229, 166/205, 296, 376, 902; 204/196.18, 196.19, 204/196.05
See application file for complete search history.

(56) References Cited

U.S. PATENT DOCUMENTS 2,882,213 A * 4/1959 Douglas ..... 204/196.19
3,273,641 A * 9/1966 Bourne ..... 166/276
4,157,732 A * 6/1979 Fonner ..... 166/376
5,048,334 A * 9/1991 Hampton et al. ..... 73/290 R
5,355,956 A 10/1994 Restarick
5,622,211 A * 4/1997 Martin et al. ..... 138/177
6,092,604 A * 7/2000 Rice et al. ..... 166/378
6,719,051 B2 4/2004 Hailey, Jr. et al.
6,857,476 B2 2/2005 Richards

OTHER PUBLICATIONS

International Fishing Devices, Inc., "Commercial Applications," 2005, 2 pages.
International Fishing Devices, Inc., "Galvanic Underwater Releases," 2005, 1 page.

* cited by examiner

*Primary Examiner*—Kenneth Thompson
(74) *Attorney, Agent, or Firm*—Marlin R. Smith

(57) ABSTRACT

A well system having a galvanic time release plug. A well system includes a flow passage and a flow blocking device which selectively obstructs flow through the passage, the device including an electrode in a galvanic cell. A flow blocking device for use in conjunction with a subterranean well includes a portion which delays an electrochemical reaction in a galvanic cell. A method of controlling fluid flow in a well system includes the steps of: obstructing flow through a passage using a flow blocking device which includes an electrode of a galvanic cell; and increasing flow through the passage by operation of the galvanic cell.

40 Claims, 8 Drawing Sheets

WELL SYSTEM HAVING GALVANIC TIME RELEASE PLUG

BACKGROUND

The present invention relates generally to equipment utilized and operations performed in conjunction with subterranean wells and, in an embodiment described herein, more particularly provides a well system having a galvanic time release plug.

It is well known to temporarily prevent flow through a passage in a well by use of a dissolvable plug. Typically, the plug is dissolved by circulating acid to the plug. However, this method of temporarily preventing flow through a passage presents problems in certain situations.

For example, if acidic fluids are to be used in the well prior to the time at which it is desired to dissolve the plug, premature dissolving of the plug could result. It will be appreciated by those skilled in the art that acid is commonly used in completion cleanup operations, and so if it is desired to delay permitting flow through a passage until after completion cleanup operations are concluded, then a plug readily dissolvable in acid should not typically be used.

Therefore, it may be seen that improvements in the art of temporarily obstructing passages in wells are needed.

SUMMARY

In carrying out the principles of the present invention, a flow blocking device, well system and associated methods are provided which solve at least one problem in the art. One example is described below in which an electrochemical reaction in a galvanic cell is used to dissolve or otherwise disperse a plug portion of a flow blocking device. Another example is described below in which the electrochemical reaction is delayed by isolating an electrode of the galvanic cell from an electrolyte, or by providing an electrode with a material initially exposed to the electrolyte which is closer (as compared to another material of the electrode) in the galvanic series to a material of another electrode in the galvanic cell.

In one aspect of the invention, a well system is provided which includes a flow passage and a flow blocking device which temporarily obstructs flow through the passage. The device includes a portion which is included in an electrode in a galvanic cell, so that the device eventually permits increased flow through the passage.

In another aspect of the invention, a flow blocking device is provided for use in conjunction with a subterranean well. The device includes an electrode in a galvanic cell, the electrode including at least one portion of the device. Another portion of the device delays an electrochemical reaction in the galvanic cell.

In yet another aspect of the invention, a method of controlling fluid flow in a well system includes the steps of: obstructing flow through a passage using a flow blocking device which includes an electrode of a galvanic cell; and increasing flow through the passage by operation of the galvanic cell.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
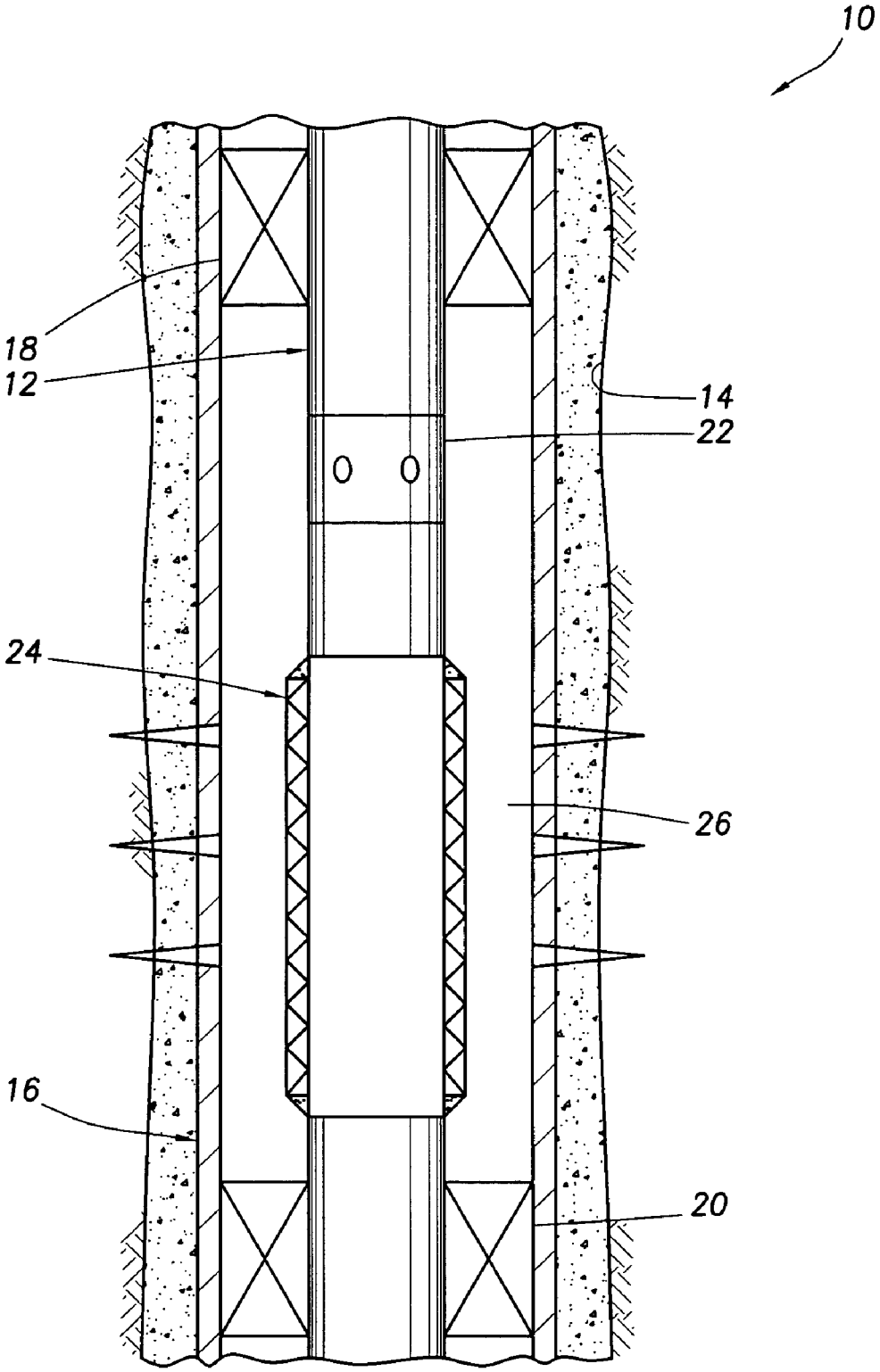
FIG. 1 is a schematic partially cross-sectional view of a well system embodying principles of the present invention.

Representatively illustrated in FIG. 1 is a well system 10 and associated method which embody principles of the present invention. In the well system 10, a tubular string 12 (such as a completion string) is installed in a wellbore 14 which is lined with a liner or casing string 16. It is not necessary for the tubular string 12 to be installed in the casing string 16, for example, the tubular string could instead be installed in an uncased or open hole section of the wellbore 14.

In this example, the tubular string 12 is used to produce hydrocarbons from the well after a gravel packing operation. However, it should be clearly understood that other types of tubular strings may be used, and other types of operations may be conducted, in conjunction with a subterranean well in keeping with the principles of the invention.

The tubular string 12 includes upper and lower packers 18, 20 for isolating a perforated zone of the well, a crossover tool 22 for directing flow of a gravel slurry into an annulus 26 formed between the tubular string 12 and the casing string 16, and a well screen assembly 24 for preventing gravel, debris and formation fines from being produced through the tubular string. Additional or different equipment may be included in the tubular string 12, if desired (for example, the lower packer 20 could instead be a bridge plug, multiple zones could be gravel packed, etc.).

In one feature of the well system 10, outward flow through the screen assembly 24 is prevented during installation of the tubular string 12 (for example, so that circulating fluid flow will not damage or plug the screen assembly), and increased inward flow through the screen assembly is permitted after the gravel packing and completion cleanup operations (so that relatively unrestricted production fluid flow is obtained). However, it should be clearly understood that this is only one example of the wide variety of beneficial uses of the principles of the invention, and it is not necessary for any particular feature of the well system 10 to be utilized in keeping with the principles of the invention.

Figure 2:
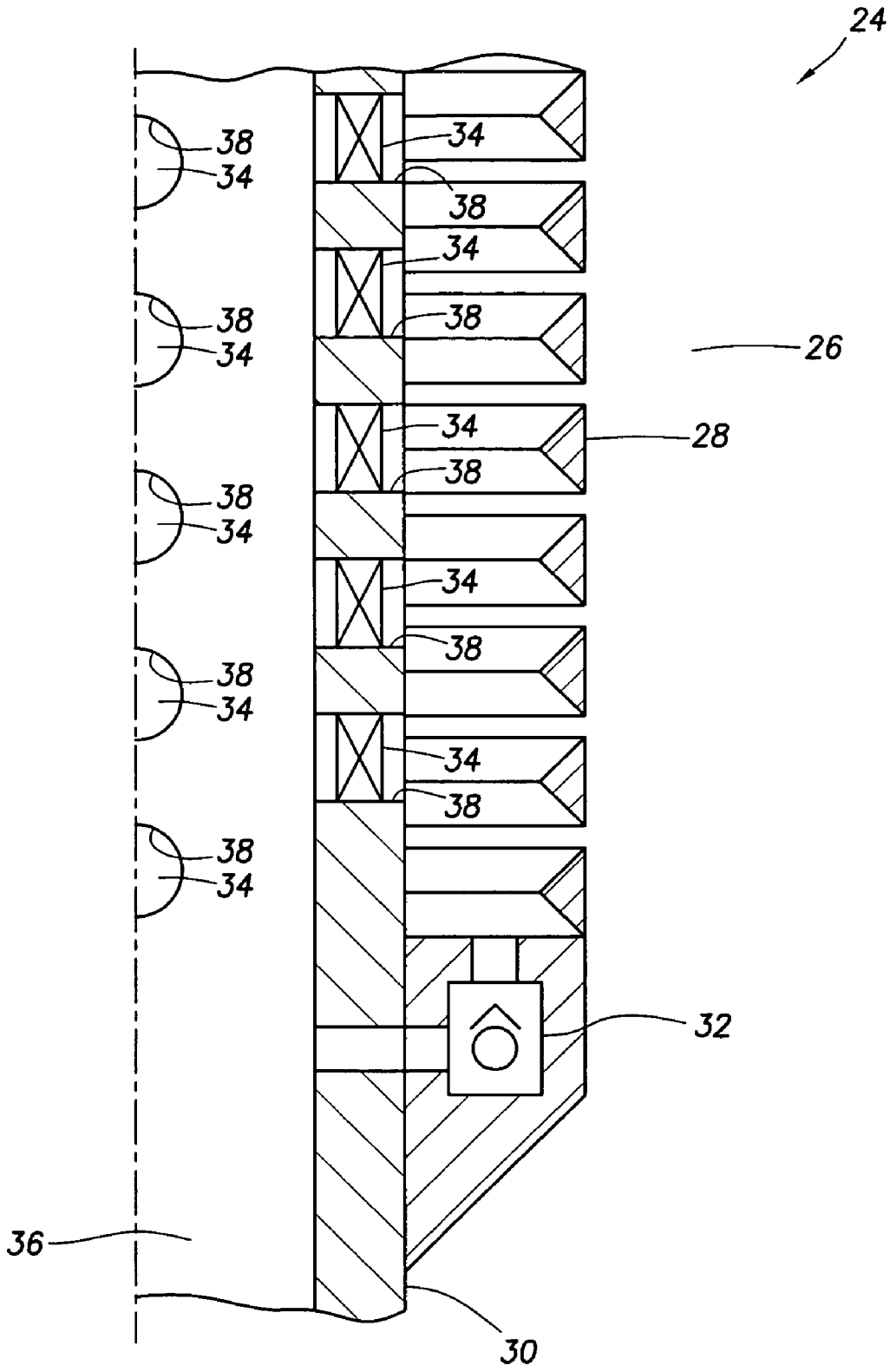
FIG. 2 is an enlarged scale schematic cross-sectional view of a portion of a well screen assembly in the system of FIG. 1.

Referring additionally now to FIG. 2, an enlarged scale cross-sectional view of a section of the screen assembly 24 is representatively illustrated. In this view, it may be seen that the screen assembly 24 includes a filter portion 28 which overlies a generally tubular base pipe 30.

The filter portion 28 is depicted as being a wire-wrapped filter portion, which would typically be spaced apart from the base pipe 30 using a series of longitudinally extending and circumferentially spaced apart rods (not shown in FIG. 2). However, any other type of screen assembly, filtering portion, base pipe, etc. may be used in keeping with the principles of the invention.

In the well system 10, the base pipe 30 is interconnected as a part of the tubular string 12, so that an inner flow passage 36 of the tubular string passes longitudinally through the base pipe. Although only one screen assembly 24 is shown in the well system 10 of FIG. 1, any number of screen assemblies may be used in keeping with the principles of the invention.

The screen assembly 24 is depicted in FIG. 2 as including a one-way valve 32 which permits inwardly directed flow (e.g., from the annulus 26 to the interior of the tubular string 12 in the well system 10), but prevents oppositely directed outward flow through the screen assembly 24. An example of such a one-way valve is described in U.S. Pat. No. 6,857,476, the entire disclosure of which is incorporated herein by this reference. However, use of such a one-way valve is not necessary in keeping with the principles of the present invention.

The screen assembly 24 also includes multiple plugs or flow blocking devices 34 which preferably completely prevent flow through corresponding multiple flow passages 38 formed radially through the base pipe 30. The devices 34 could instead only partially obstruct flow through the passages 38 (for example, in the manner of an orifice or nozzle), or could permit one-way flow through the passages, etc., if desired.

In one feature of the screen assembly 24, increased flow through the passages 38 is permitted due to an electrochemical reaction in a galvanic cell. The electrochemical reaction is preferably delayed, so that a desired increased flow rate is achieved after the gravel packing and completion cleanup operations in the well system 10.

As described more fully below, each of the devices 34 preferably includes at least one electrode of the galvanic cell. In some examples described below, the electrode is a sacrificial anode in the galvanic cell. In another example described below, the device 34 includes two electrodes (anode and cathode) of the galvanic cell.

In other embodiments, the device 34 could be a cathode of the galvanic cell. If the device 34 is a cathode, then a portion of the base pipe 30 which secures the device in position blocking flow through the passage 38 could be a sacrificial anode of the galvanic cell, so that, as the anode dissolves or disperses, the device 34 is released to thereby permit flow through the passage 38.

Figure 3:
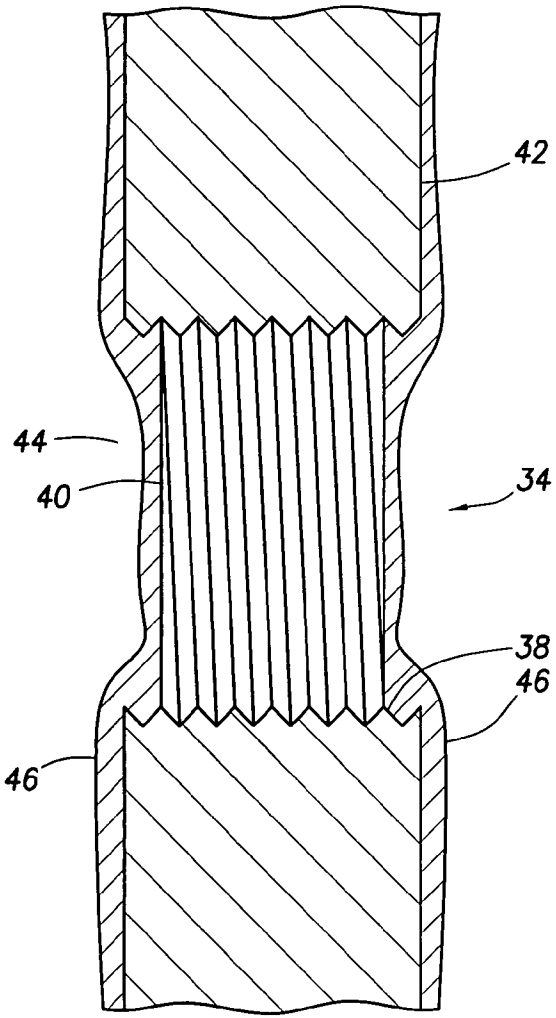
FIG. 3 is a further enlarged scale partially cross-sectional view of a flow blocking device.

Referring additionally now to FIG. 3, an enlarged scale view of the flow blocking device 34 is representatively illustrated. In this view, it may be seen that the device 34 includes an externally threaded plug portion 40 installed in the passage 38 (which is internally threaded) in a pressure-resisting wall 42 of the base pipe 30.

The plug portion 40 and the wall 42 form different electrodes in a galvanic cell. In this example, the plug portion 40 forms the anode and the wall 42 forms the cathode. In the presence of an electrolyte 44, the anode (plug portion 40) will corrode or go into solution, thereby opening or permitting increased flow through the passage 38.

The galvanic cell is formed due to the different metals or metal alloys used for the plug portion 40 and the wall 42. As used herein, the terms "metal," "metals," "metallic" and similar terms are used to indicate metals, metal alloys and combinations of metals with other materials.

The respective metals of which the plug portion 40 and the wall 42 are made are preferably separated in the galvanic (or electropotential) series. For example, the wall 42 could be made of a steel alloy and the plug portion 40 could be made of an aluminum alloy, or the wall 42 could be made of an aluminum alloy and the plug portion 40 could be made of a zinc or magnesium alloy, etc.

An isolating portion 46 initially prevents contact between the plug portion 40 and the electrolyte 44. In this manner, initiation of the electrochemical reaction in the galvanic cell can be delayed.

For example, the isolating portion 46 may be a coating applied to the interior and exterior of the wall 42 of the base pipe 30 after the plug portions 40 are installed in each of the passages 38. The portion 46 can be designed to disperse, dissolve or otherwise permit contact between the plug portion 40 and the electrolyte 44 when desired (e.g., after the gravel packing and completion cleanup operations in the well system 10).

The portion 46 could be a paint, organic and/or inorganic polymers, oxidic coating, graphitic coating, corrosion inhibitors, elastomers, coating containing breakers, etc., or combination of these which disperses, swells, dissolves and/or degrades either thermally, photo-chemically, bio-chemically and/or chemically, when contacted with a physical stimulus, such as external heat and/or solvent (such as aliphatic and aromatic hydrocarbons, ketones, aldehydes, nitrites, etc.). An example of an acceptable coating is a polystyrenecopolymer, such as poly(styrene-co-maleic acid)-partially isobutyl/methyl mixed ester, and/or chemical stimulants like the solvents described above and/or a pH breaker and/or a source of photons.

The isolating portion 46 could be designed to dissolve, disperse or otherwise permit contact between the plug portion 40 and the electrolyte 44 when an acidic fluid or a caustic fluid contacts the isolating portion.

In the well system 10, a substance which is operative to disperse, dissolve or otherwise degrade or compromise the isolating portion 46 may be circulated to the screen assembly 24 when it is desired to permit increased flow through the passages 38. Alternatively, the substance could be present in the well at the time the screen assembly 24 is installed (in which case the isolating portion 46 can be designed to disperse, dissolve or otherwise permit contact between the plug portion 40 and the electrolyte 44 after a predetermined time), or the substance could be brought into contact with the isolating portion 46 by other means (for example, upon production of hydrocarbon fluid into the screen assembly 24). Any manner of contacting the isolating portion 46 with a substance which degrades or compromises the isolating portion may be used in keeping with the principles of the invention.

The substance which degrades or compromises the isolating portion 46 is not necessarily a liquid. For example, the substance could be an acidic or caustic gas, gel, polymer, powder or solid, etc.

When the electrolyte 44 is eventually permitted to contact the plug portion 40, the electrochemical reaction in the galvanic cell causes the plug portion to corrode or go into solution in the electrolyte. Good electrical contact between the plug portion 40 and the wall 42 is desired for the electrochemical reaction to proceed. A thread sealant may be used in the threaded connection between the plug portion 40 and the wall 42, but preferably the sealant would not prevent electrical current flow between the plug portion and the wall.

As discussed above, flow through the passages 38 is preferably permitted or increased after gravel packing and completion cleanup operations in the well system 10. Since acidic fluids are typically used in completion cleanup operations, in these circumstances it may be preferable to design the isolating portion 46 so that it dissolves, degrades or otherwise permits contact between the electrolyte 44 and the plug portion 40 when a basic or caustic fluid contacts the isolating portion.

Note that it is not necessary for the electrolyte 44 to be present when the isolating portion 46 is dissolved or degraded. Instead, the electrolyte 44 could be circulated to the screen assembly 24 after the isolating portion 46 is dissolved or degraded. For example, after degrading the isolating portion 46 using a caustic or basic fluid, an acidic or neutral pH fluid could be circulated to the screen assembly 24 for use as the electrolyte 44.

Figure 4:
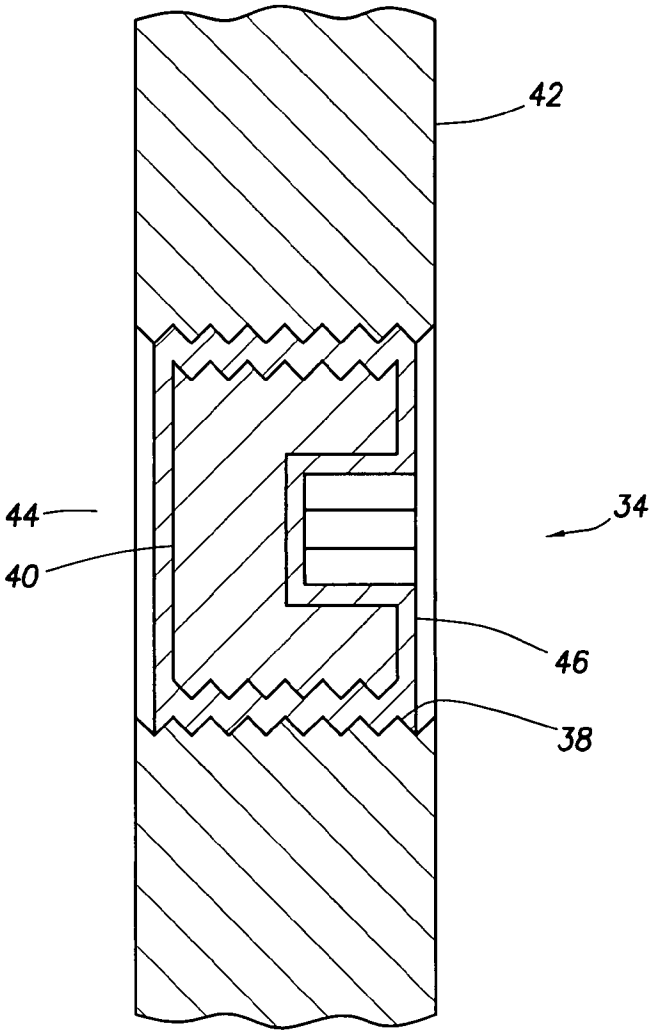
FIGS. 4-14 are cross-sectional views of alternate configurations of the flow blocking device.

Referring additionally now to FIG. 4, an alternate configuration of the flow blocking device 34 is representatively illustrated. In this alternate configuration, the isolating portion 46 temporarily isolates the plug portion 40 from contact with the electrolyte 44 (as with the configuration depicted in FIG. 3), and also provides temporary electrical insulation between the plug portion and the wall 42.

After the isolating portion 46 is dissolved or degraded (for example, as described above), the plug portion 40 is in electrical contact with the wall 42, and is in contact with the electrolyte 44. The electrochemical reaction in the galvanic cell can then proceed, and flow through the passage 38 will be permitted or otherwise increased.

Figure 5:
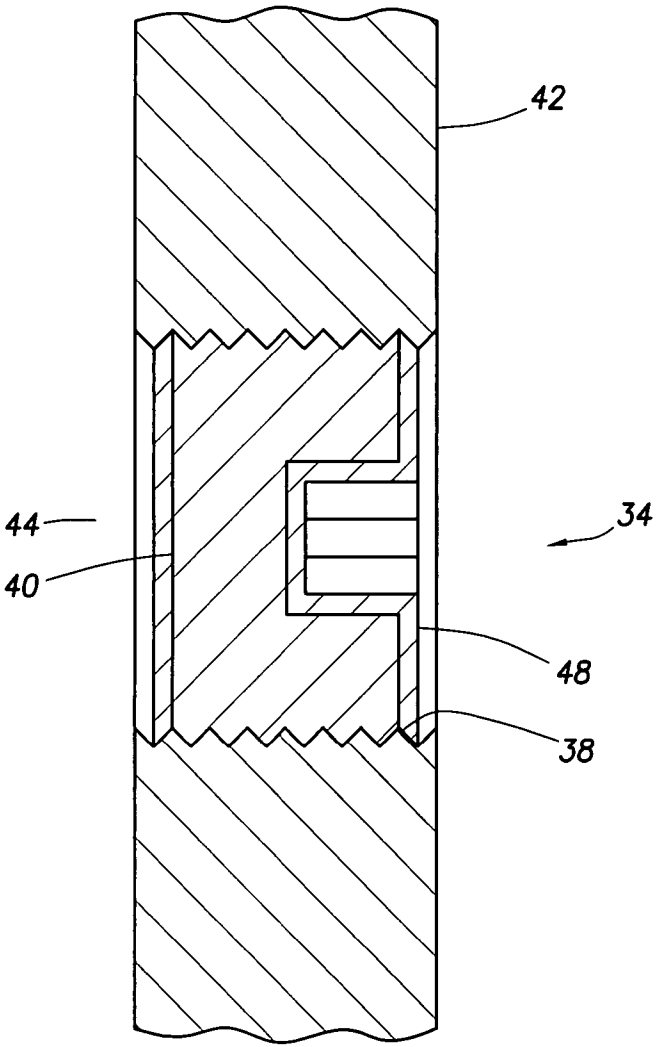

Referring additionally now to FIG. 5, another alternate configuration of the flow blocking device 34 is representatively illustrated. In this alternate configuration, the plug portion 40 is initially in electrical contact with the wall 42 (as with the configuration depicted in FIG. 3), but the device 34 includes another type of delaying portion 48 instead of the isolating portion 46 depicted in FIGS. 2 & 3.

The delaying portion 48 is part of the galvanic cell, in that the delaying portion is also made of a metal or metal alloy. However, the metal of which the delaying portion 48 is made is closer than the metal of which the plug portion 40 is made to the metal of which the wall 42 is made in the galvanic series.

As a result, the electrochemical reaction in the galvanic cell will proceed more slowly while the delaying portion 48 is exposed to the electrolyte 44 and isolates the plug portion 40 from contact with the electrolyte. In this manner, the rate of the electrochemical reaction may be controlled, so that the passage 38 can be opened to flow at a predetermined time in the future.

While the delaying portion 48 isolates the plug portion 40 from the electrolyte 44, the electrochemical reaction proceeds relatively slowly (for example, during the gravel packing and completion cleanup operations in the well system 10). However, after a predetermined time delay (for example, at which time the gravel packing and completion cleanup operations have been concluded), the delaying portion 48 will be sufficiently dissolved or placed in solution to allow contact between the plug portion 40 and the electrolyte, and the electrochemical reaction rate will substantially increase to thereby relatively quickly compromise the structural integrity of the plug portion.

For example, if the wall 42 is made of a steel alloy, then the plug portion 40 could be made of a magnesium alloy and the delaying portion 48 could be made of an aluminum alloy (such as 2024 aluminum alloy) which is relatively close to the steel alloy in the galvanic series. Note that, in the configuration of FIG. 5, the plug portion 40 and the delaying portion 48 are both portions of an electrode (preferably the anode) in the galvanic cell.

However, it is not necessary for both of the delaying portion 48 and the plug portion 40 to be portions of an electrode in the galvanic cell. For example, the delaying portion 48 could be an electrode in the galvanic cell, but the plug portion 40 could be made of a material (such as salt, etc.) which dissolves or disperses by other than galvanic action.

Although only one delaying portion 48 is depicted in FIG. 5, any number of delaying portions may be used in keeping with the principles of the invention. Furthermore, any of the features of the different configurations of flow blocking devices described herein may be used with any of the other configurations. For example, the configuration of FIG. 5 could be provided with an isolating portion 46 in the form of a coating or other layer which temporarily isolates the delaying portion 48 from contact with the electrolyte 44.

Figure 6:
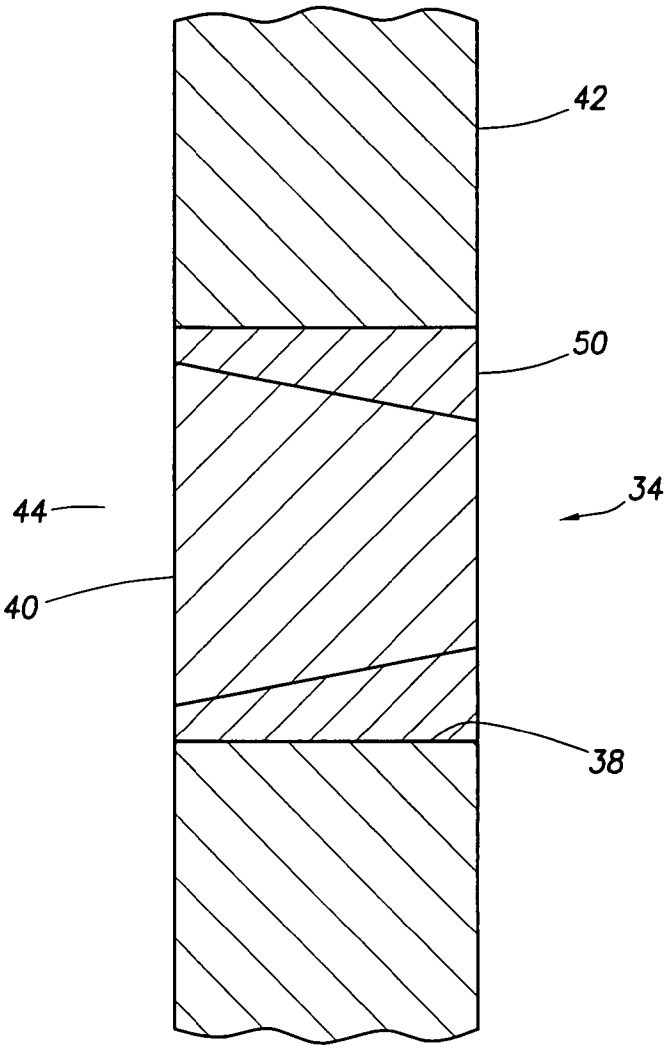

Referring additionally now to FIG. 6, another alternate configuration of the flow blocking device 34 is representatively illustrated. In this configuration, the device 34 is press-fit, shrink-fit, adhesively bonded or otherwise secured in the passage 38, instead of being threaded therein.

In addition, the device 34 as installed in the passage 38 includes both an anode and a cathode of the galvanic cell. For example, the central plug portion 40 is an electrode and an outer portion 50 between the plug portion and the wall 42 is another electrode of the galvanic cell.

The plug portion 40 could, for example, be made of a magnesium alloy, and the outer portion 50 could be made of an aluminum alloy. In that circumstance, the plug portion 40 would be the anode and the outer portion 50 would be the cathode in the galvanic cell.

In the presence of the electrolyte 44, the plug portion 40 would dissolve or go into solution in the electrolyte, thereby eventually permitting flow through the passage 38. If the wall 42 is made of a steel alloy, then the outer portion 50 would also form an anode and the wall would form a cathode, so that the outer portion 50 would also eventually dissolve or go into solution in the electrolyte 44, thereby further increasing flow through the passage 38.

Alternatively, the outer portion 50 could be more cathodic than either the plug portion 40 or the wall 42. In that case, additional electrical potential created by the more cathodic outer portion 50 will increase the rate of the galvanic reaction with the plug portion 40. For example, the outer portion 50 could be made of a copper alloy or lead. As another alternative, the plug portion 40 could be more cathodic than either the outer portion 50 or the wall 42.

Figure 7:
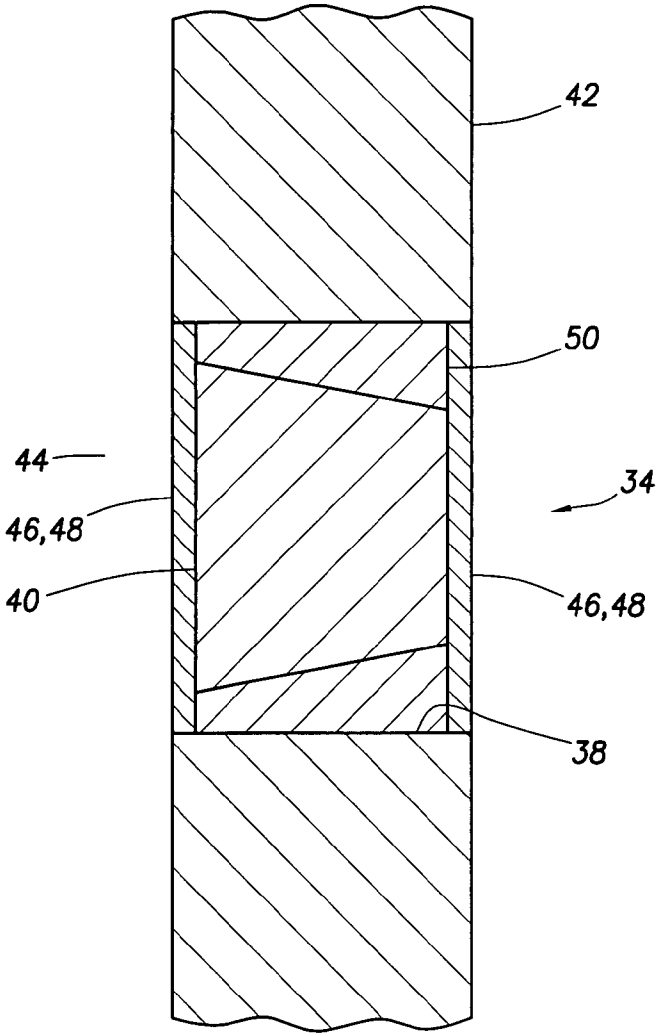

Referring additionally now to FIG. 7, another alternate configuration of the flow blocking device 34 is representatively illustrated. In this configuration, an isolating portion 46 and/or a delaying portion 48 is used to delay exposure of the plug portion 40 and outer portion 50 to the electrolyte 44. The isolating portion 46 and delaying portion 48 may be any of those types described herein.

Figure 8:
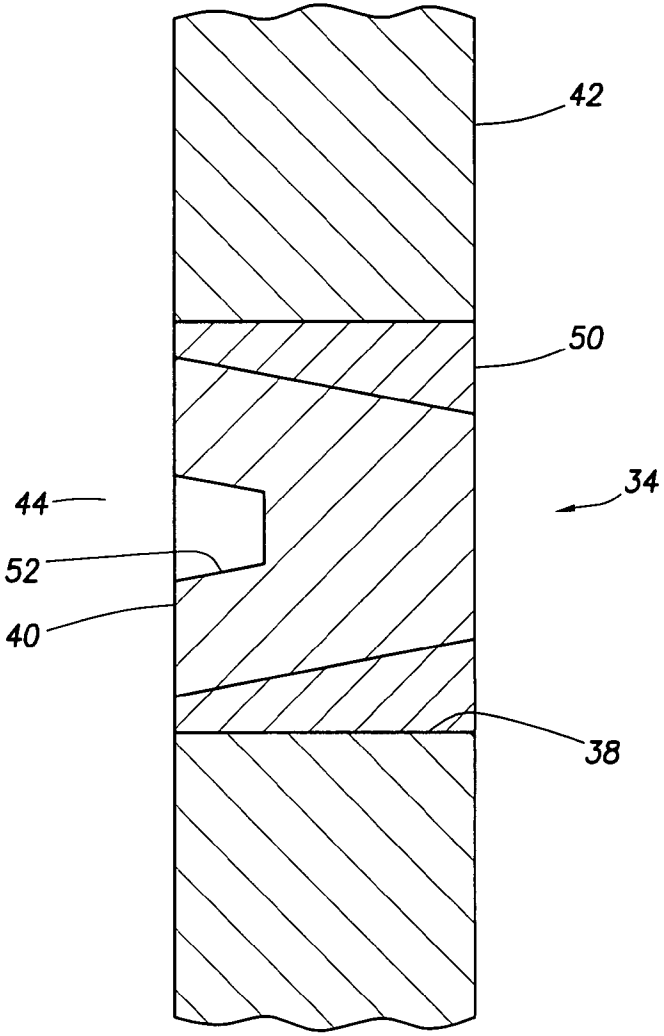

Referring additionally now to FIG. 8, another alternate configuration of the flow blocking device 34 is representatively illustrated. In this configuration, a recess 52 is formed in the plug portion 40, in order to prevent the corroded plug portion from becoming debris in the passage 36.

Figure 9:
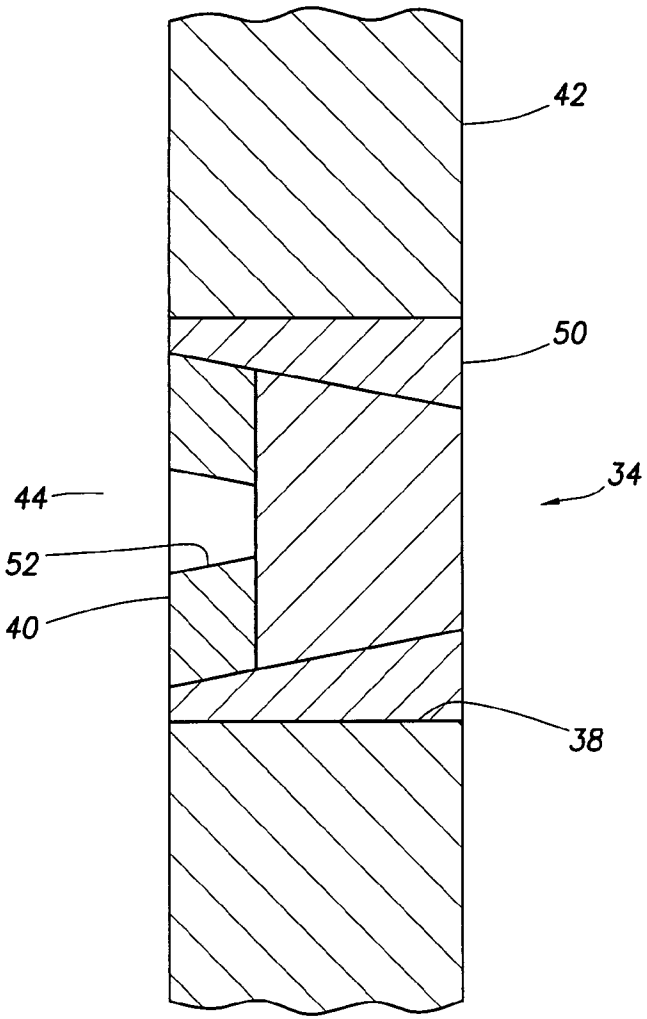

In FIG. 9, the device 34 of FIG. 8 is depicted after a substantial part of the plug portion 40 has dissolved or gone into solution in the electrolyte 44. As soon as the recess 52 is reached, flow through the passage 38 is permitted, thereby decreasing the pressure differential across the wall 42, and thus dislodging of the remaining part of the plug portion 40 into the passage 36 is avoided. The remaining part of the plug portion 40 will eventually dissolve, thereby further opening the passage 38 to flow.

Figure 10:
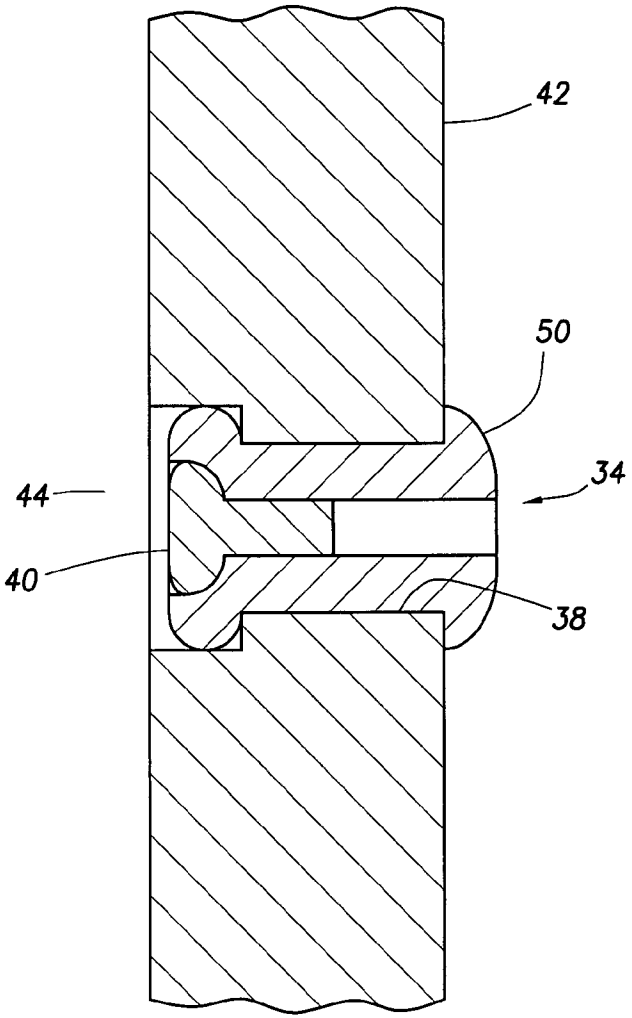

Referring additionally now to FIG. 10, another alternate configuration of the flow blocking device 34 is representatively illustrated. In this configuration, the plug portion 40 and outer portion 50 are in the form of a rivet installed in the wall 42.

For example, the plug portion 40 and outer portion 50 could both be made of an aluminum alloy, and the wall 42 could be made of a steel alloy, so that in the presence of the electrolyte 44 the plug and outer portions form an anode and the wall forms a cathode in the galvanic cell (similar to the configuration of FIG. 3).

Other configurations and materials could be used instead. For example, the plug portion 40 could be made of a magnesium alloy, and the outer portion 50 could be made of an aluminum alloy, so that in the presence of the electrolyte 44 the plug portion forms an anode and the outer portion forms a cathode in the galvanic cell (similar to the configuration of FIG. 6).

Seals, such as o-rings, sealants, etc., may be used between the plug portion 40, outer portion 50 and/or wall 42 to enhance sealing. Additional isolating and/or delaying elements (such as the isolating and delaying portions 46, 48 described above) may be used to delay the electrochemical reaction in the galvanic cell, if desired.

Figure 11:
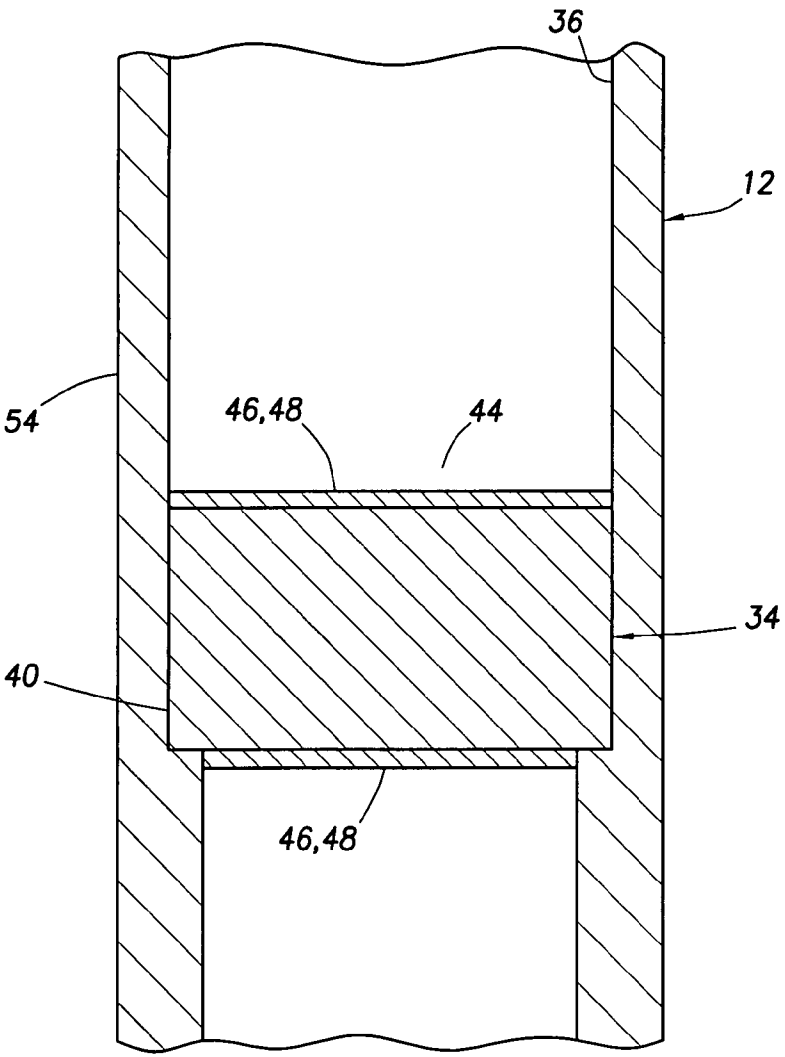

Referring additionally now to FIG. 11, another alternate configuration of the flow blocking device 34 is representatively illustrated. In this configuration, the device 34 is used to obstruct flow through the passage 36 in the tubular string 12.

The passage 36 extends longitudinally through a generally tubular housing 54 interconnected in the tubular string 12. The device 34 initially obstructs flow through the passage 36. However, when the plug portion 40 is eventually sufficiently dissolved or placed in solution due to the electrochemical reaction in the galvanic cell, flow through the passage 36 will be permitted, or at least increased.

The device 34 may be provided with an isolating portion 46 and/or delaying portion 48, in order to delay the electrochemical reaction, as described above. A recess (such as the recess 52 described above) may be formed in the plug portion 40, so that it will not become dislodged and result in debris in the passage 36.

Figure 12:
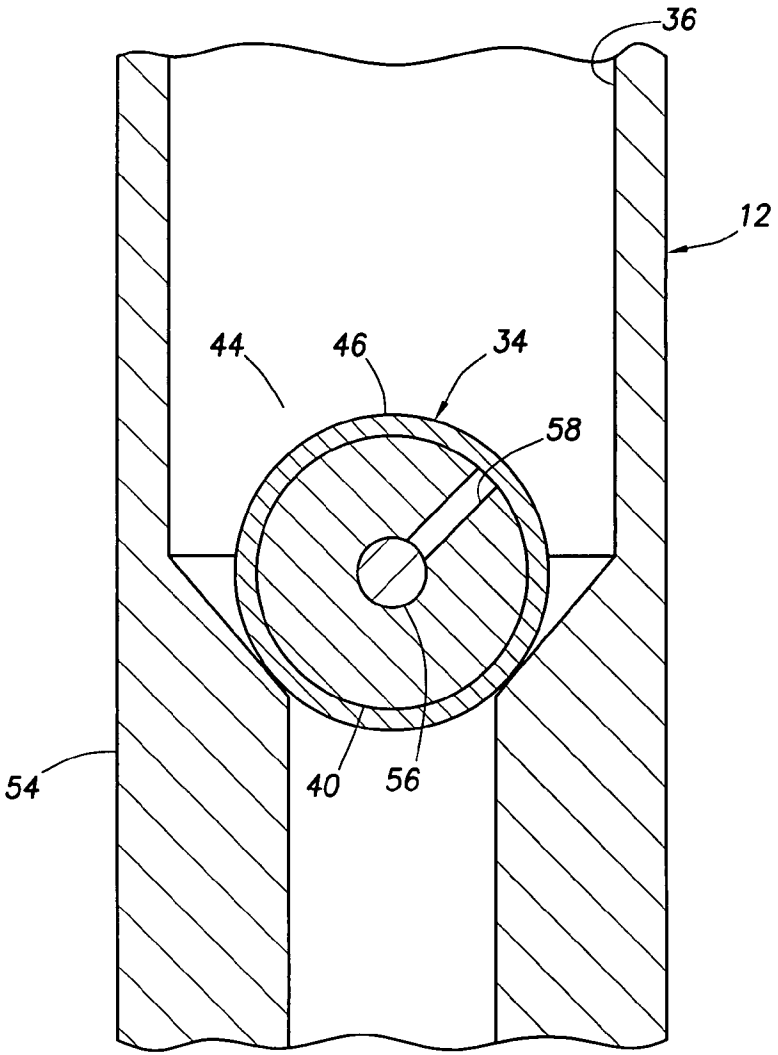

Referring additionally now to FIG. 12, another alternate configuration of the flow blocking device 34 is representatively illustrated. In this configuration, the device 34 is in the form of a ball, although other shapes (such as darts, cones, etc.) could be used, if desired.

The device 34 is separate from the housing 54, and the device may be installed in the passage 36 before or after the tubular string 12 is installed in the well. As depicted in FIG. 12, the device 34 permits one-way flow through the passage 36, but latching devices or other types of devices may be provided to prevent flow in either direction through the passage, if desired.

The device 34 preferably includes both electrodes of the galvanic cell. For example, the plug portion 40 could be the anode, and an inner portion 56 could be the cathode (e.g., if the plug portion is made of an aluminum alloy and the inner portion is made of a steel alloy, etc.).

The isolating portion 46 prevents contact between the plug and inner portions 40, 56 and the electrolyte 44, until the isolating portion has been sufficiently dissolved, dispersed or otherwise degraded. At that point, a passage 58 formed in the plug portion 40 allows the electrolyte 44 to contact the inner portion 56. Alternatively, the isolating portion 46 could temporarily prevent contact between the electrolyte 44 and only one of the plug and inner portions 40, 56, if desired.

When the electrolyte 44 contacts both of the plug and inner portions 40, 56, the plug portion will dissolve or go into solution in the electrolyte due to the electrochemical reaction in the galvanic cell. Eventually, the plug portion 40 will be sufficiently dissolved or corroded that it can no longer obstruct flow through the passage 36.

Figure 14:
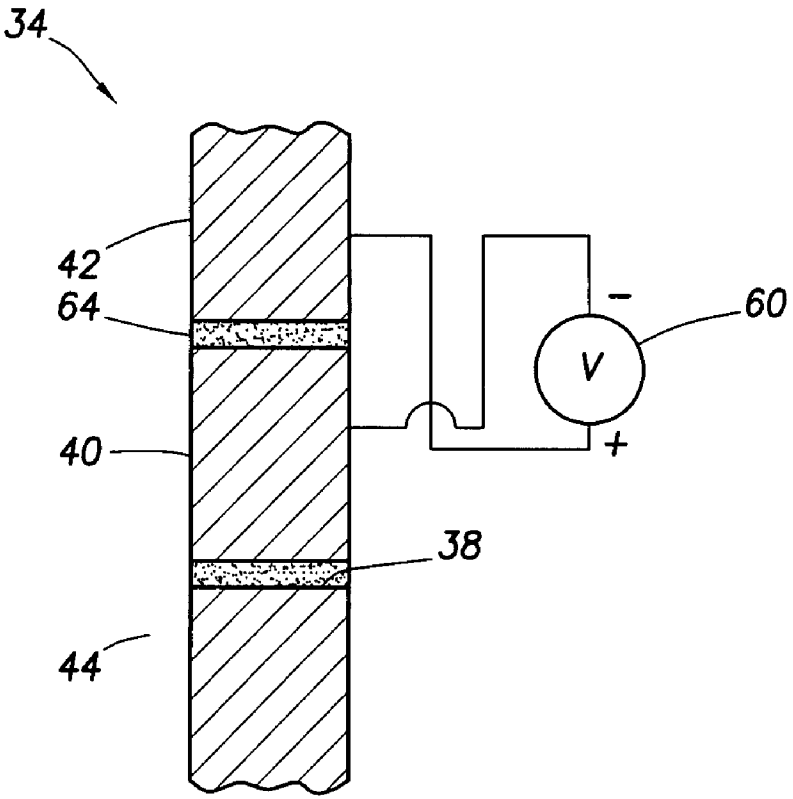
Figure 13:
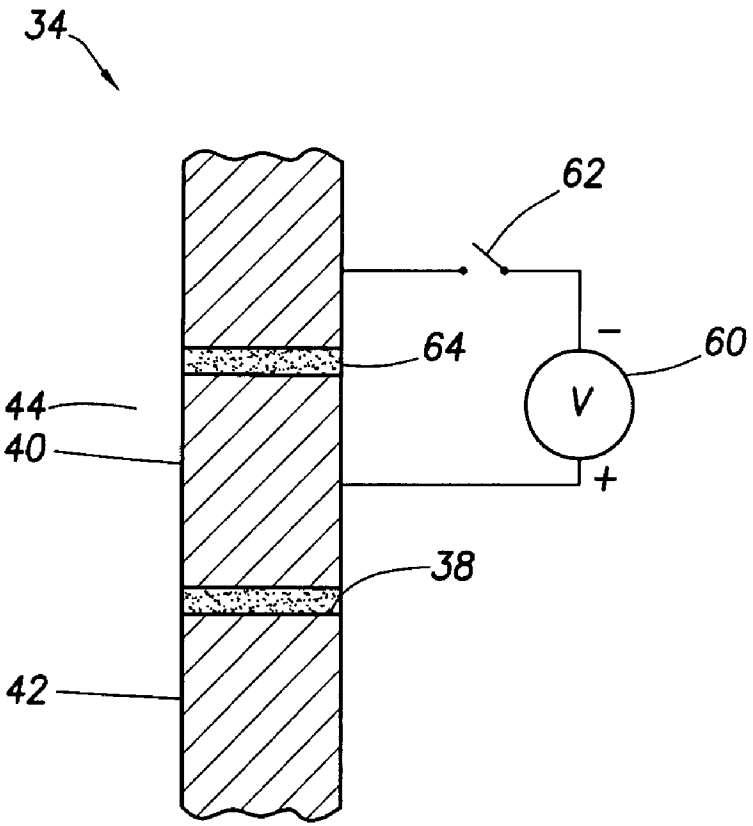

Referring additionally now to FIGS. 13 & 14, another alternate configuration of the flow blocking device 34 is representatively illustrated. In this configuration, the plug portion 40 may be similar to that of any of the configurations described above. The plug portion 40 is used to block flow through the passage 38 in the wall 42, as in the configurations of FIGS. 2-10, but similar principles could be used in the configurations of FIGS. 11 & 12.

In the galvanic cells described above, the plug portion 40 is at a more positive or more negative potential as compared to another component of the device 34 in the presence of the electrolyte 44. In the configuration of FIGS. 13 & 14, a battery or other source of electrical potential 60 is used to stop, slow or increase the rate of the electrochemical reaction in the galvanic cell.

For example, if in the galvanic cell the plug portion 40 would otherwise have a negative potential and the wall 42 would have a positive potential, the electrical potential source 60 could be connected as depicted in FIG. 13. When a switch 62 is open, the electrochemical reaction of the galvanic cell proceeds at a rate determined by the materials of which the plug portion 40 and wall 42 are made, the electrolyte 44, etc.

However, when the switch 62 is closed, the potential source 60 applies a relative positive potential to the plug portion 40, and a relative negative potential to the wall 42. The relative positive and negative potentials applied by the potential source 60 may be sufficient to slow or even stop the electrochemical reaction in the galvanic cell.

The application of electrical potential to the plug portion 40 and the wall 42 by the potential source 60 may be used to cause degradation of the plug portion 40 over an extended predetermined period of time, and/or opening of the switch 62 may be delayed until a predetermined time at which it is desired to cause degradation of the plug portion. Of course, if in the galvanic cell the plug portion 40 would otherwise have a positive potential and the wall 42 would have a negative potential (i.e., the plug portion is the cathode and the wall is the anode in the galvanic cell), the electrical potential source 60 could be connected opposite to the manner depicted in FIG. 13 in order to slow, stop or delay degradation of the wall.

In FIG. 14, the potential source 60 has been connected to the plug portion 40 and the wall 42 in a manner which increases the rate of the electrochemical reaction in the galvanic cell. The plug portion 40 is the anode and the wall 42 is the cathode in the galvanic cell (as in FIG. 13), but the potential source 60 is used to increase the relative positive potential of the wall, and to increase the relative negative potential of the plug portion.

A switch (not shown) could be connected between the potential source 60 and the plug portion 40 and wall 42, so that the device 34 could be alternated between the configurations depicted in FIG. 13 & 14. Thus, with the switch 62 closed, the electrochemical reaction in the galvanic cell could be stopped while the potential source 60 is connected to the plug portion 40 and wall 42 as shown in FIG. 13, but when it is desired to degrade the plug portion and permit flow through the passage 38 (for example, in response to a predetermined circumstance, such as completion of the gravel packing and completion cleanup operations in the well system 10), another switch could be actuated to connect the potential source to the plug portion and wall as shown in FIG. 14, at which time the plug portion will relatively rapidly degrade.

Again, if the plug portion 40 is the cathode and the wall portion 42 is the anode in the galvanic cell, then the connection of the potential source 60 to these components would preferably be the reverse of that described above.

As depicted in FIGS. 13 & 14, an insulator 64 may be used between the plug portion 40 and the wall 42 to reduce the electrical potential between these components and thereby reduce the potential applied by the potential source 60 to cause the results described above. The insulator 64 could be similar in various respects to the isolating portion 46 described above, except that the insulator preferably permits contact between the electrolyte 44 and each of the plug portion 40 and the wall 42. However, the insulator 64 could prevent electrical contact between the electrolyte 44 and one or both of the plug portion 40 and wall 42 (such as, for a predetermined time, as described above for the isolating portion 46).

Although several examples of the many beneficial uses of the principles of the invention have been described above, it will be appreciated that it would be impractical to describe every possible configuration of flow blocking devices, well systems or methods which could incorporate the principles of the invention. Thus, it should be clearly understood that the examples described above do not in any way limit the possible applications for the principles of the invention.

Note that any manner of dissolving, degrading or otherwise compromising the isolating portion 46 may be used. The isolating portion 46 could, for example, be mechanically compromised (such as by scraping, vibrating or piercing the isolating portion, etc.) or opened using pressure (such as by applying a predetermined differential pressure across the isolating portion to burst it, shift a pressure isolating member, etc.). Heat could be used to melt, or at least substantially weaken and compromise, the isolating portion 46. Light could be used to compromise the isolating portion 46. A component of the isolating portion 46 itself (such as a solvent, pH breaker, photon source, etc.) may be used to compromise the isolating portion.

The isolating portion 46 may be in the form of a coating, layer, membrane, elastomer, molding, plating, rupture disc, or any other structure capable of isolating and/or insulating.

Furthermore, any type of substance could be used to dissolve, degrade or otherwise compromise the isolating portion 46. For example, an acidic, caustic or neutral pH fluid could be used to compromise the isolating portion 46. Fluids or other types of substances (such as water, hydrocarbons, solvents, acids, bases, solids, powders, mixtures of any of these, etc.) could be used to compromise the isolating portion 46.

In the well system 10, the isolating portion 46 could be made of a material which is resistant to degradation in acidic completion fluid, but which degrades when exposed to a caustic fluid. After the gravel packing and completion cleanup operations, a caustic fluid could be circulated to the screen assembly 24 to degrade the isolating portion 46. The plug portion 40 can then be exposed to the electrolyte 44 to start the electrochemical reaction in the galvanic cell.

The substance used to compromise the isolating portion 46 may be the same fluid as, or a different fluid from, the electrolyte 44. The electrolyte 44 may be any type of electrolyte which will support the electrochemical reaction in the galvanic cell.

For example, the electrolyte 44 may be acidic, caustic or neutral pH. If the anode is an aluminum alloy, then an acidic or caustic electrolyte 44 may be preferred, instead of a neutral pH electrolyte, to avoid formation of a passivation layer on the aluminum, unless a reduced rate of the electrochemical reaction is desired. A preferred electrolyte 44 may be hydrochloric acid diluted with salt water.

An alcohol based solvent could be used to dissolve or otherwise degrade the isolating portion 46, and then a mixture of hydrochloric acid diluted with sea water could be used as the electrolyte 44 to promote the electrochemical reaction in the galvanic cell.

Any combination of metals may be used for the plug portion 40, wall 42, outer portion 50, housing 54 and inner portion 56 in the various configurations of the flow blocking device 34 described above. Any feature of one of the configurations described above may be used in another of the configurations.

For example, the recess 52 in the configuration of FIGS. 8 & 9 could be used in any of the other configurations of FIGS. 3-7 and 10-14. Any combination and number of isolating and delaying portions 46, 48 may be used in any of the configurations described above to delay the electrochemical reaction in the galvanic cell.

The delaying portion 48 may be in the form of a plating, layer, functionally graded material, or any other structure or material which delays, but does not prevent, the electrochemical reaction in the galvanic cell.

The rate of the electrochemical reaction in the galvanic cell is dependent on certain factors, among which are temperature, concentration of ions in the electrolyte 44, separation between the electrode materials in the galvanic series, etc. These factors may be manipulated to produce a desired predetermined time delay before flow through the passage 36 or 38 is permitted, or is increased to a desired level.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A well system, comprising:

a flow passage; and a flow blocking device which selectively obstructs flow through the passage, the device including a first electrode in a galvanic cell, and a first isolating portion which delays an electrochemical reaction in the galvanic cell for a predetermined period of time.

2. The well system of claim 1, wherein the first electrode is an anode in the galvanic cell.

3. The well system of claim 1, wherein the device is positioned in a pressure-resistant wall, and wherein the wall includes a second electrode in the galvanic cell.

4. The well system of claim 1, wherein the flow passage extends in a housing, and wherein the housing includes a second electrode in the galvanic cell.

5. The well system of claim 1, wherein the first isolating portion comprises an insulator which interrupts an electrical circuit created by the first electrode and a second electrode.

6. The well system of claim 1, wherein the device initially prevents flow through the passage, and after the predetermined period of time permits flow through the passage.

7. The well system of claim 1, wherein the device includes a second electrode in the galvanic cell.

8. The well system of claim 1, wherein the first electrode is electrically connectable to an electrical potential source.

9. The well system of claim 8, wherein the electrical potential source is operative to decrease a rate of electrochemical reaction in the galvanic cell.

10. The well system of claim 8, wherein the electrical potential source is operative to increase a rate of electrochemical reaction in the galvanic cell.

11. The well system of claim 8, wherein the electrical potential source is connected between the first electrode and a second electrode of the galvanic cell.

12. A well system, comprising:

a flow passage;

a flow blocking device which selectively obstructs flow through the passage, the device including an electrode in a galvanic cell; and a first portion which delays an electrochemical reaction in the galvanic cell, wherein the electrode includes the first portion and a second portion, and wherein the electrochemical reaction proceeds at respective different rates when the first and second portions are exposed to an electrolyte in the galvanic cell.

13. A well system, comprising:

a flow passage; and a flow blocking device which selectively obstructs flow through the passage, the device including an electrode in a galvanic cell, and an isolating portion which delays an electrochemical reaction in the galvanic cell, wherein the device substantially obstructs flow through the passage during a gravel packing operation, and permits increased flow through the passage after the gravel packing operation.

14. A flow blocking device for use in conjunction with a subterranean well, the device comprising:

a first isolating portion which delays an electrochemical reaction in a galvanic cell for a predetermined period of time during which the flow stopping device blocks flow through a passage.

15. The device of claim 14, wherein the first isolating portion comprises an insulator which insulates a second portion from electrical communication with an electrode of the galvanic cell.

16. The device of claim 14, wherein the first isolating portion is part of an electrode of the galvanic cell.

17. The device of claim 14, wherein the first isolating portion comprises a coating on a second portion which is part of an electrode of the galvanic cell.

18. The device of claim 14, wherein the first isolating portion obstructs contact between an electrode and an electrolyte in the galvanic cell.

19. The device of claim 14, wherein the first isolating portion obstructs electrical current transmission between electrodes in the galvanic cell.

20. The device of claim 14, wherein the first isolating portion is part of an anode in the galvanic cell.

21. The device of claim 14, wherein the device includes first and second electrodes of the galvanic cell.

22. The device of claim 14, wherein a first electrode of the galvanic cell is electrically connectable to an electrical potential source.

23. The device of claim 22, wherein the electrical potential source is operative to decrease a rate of electrochemical reaction in the galvanic cell.

24. The device of claim 22, wherein the electrical potential source is operative to increase a rate of electrochemical reaction in the galvanic cell.

25. The device of claim 22, wherein the electrical potential source is connected between the first electrode and a second electrode of the galvanic cell.

26. A method of controlling fluid flow in a well system, the method comprising the steps of:

obstructing flow through a passage using a flow blocking device which includes a first electrode of a galvanic cell, and a first isolating portion which delays an electrochemical reaction in the galvanic cell for a predetermined period of time; and increasing flow through the passage by operation of the galvanic cell.

27. The method of claim 26, wherein the flow obstructing step is performed prior to the flow increasing step.

28. The method of claim 26, wherein the flow obstructing step is performed during a gravel packing operation, and wherein the flow increasing step is performed after the gravel packing operation.

29. The method of claim 26, wherein the flow obstructing step further comprises obstructing flow through the passage which is formed in a housing.

30. The method of claim 29, further comprising the step of providing the housing as part of a tubular string.

31. The method of claim 29, wherein the housing includes a second electrode in the galvanic cell.

32. The method of claim 26, wherein the device includes a second electrode in the galvanic cell.

33. The method of claim 26, further comprising the step of electrically connecting the first electrode to an electrical potential source.

34. The method of claim 33, wherein the connecting step further comprises decreasing a rate of electrochemical reaction in the galvanic cell.

35. The method of claim 33, wherein the connecting step further comprises increasing a rate of electrochemical reaction in the galvanic cell.

36. The method of claim 33, wherein the connecting step further comprises connecting the electrical potential source between the first electrode and a second electrode of the galvanic cell.

37. A method of controlling fluid flow in a well system, the method comprising the steps of:

obstructing flow through a passage using a flow blocking device which includes a first electrode of a galvanic cell, and an isolating portion which delays an electrochemical reaction in the galvanic cell, and the flow obstructing step further including obstructing flow through the passage which is formed in a pressure-resisting wall; and increasing flow through the passage by operation of the galvanic cell.

38. The method of claim 37, further comprising the step of providing the wall as part of a well screen.

39. The method of claim 38, wherein the providing step further comprises providing the wall as a base pipe of the well screen.

40. The method of claim 37, wherein the wall includes a second electrode in the galvanic cell.

* * * * *